US010405678B1

(12) United States Patent
DeSena

(10) Patent No.: US 10,405,678 B1
(45) Date of Patent: Sep. 10, 2019

(54) APPARATUS AND METHOD FOR ILLUMINATING ITEMS OF MERCHANDISE SUSPENDED IN A PEG-TYPE DISPLAY HAVING AN ELONGATE BEAM WITH TRACK THAT IS SECURED TO A TERMINAL END OF A BAR

(71) Applicant: Henschel-Steinau, Inc., Allendale, NJ (US)

(72) Inventor: Michael D. DeSena, West Caldwell, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 15/938,275

(22) Filed: Mar. 28, 2018

(51) Int. Cl.
*A47F 11/10* (2006.01)
*A47F 9/04* (2006.01)
*A47F 5/00* (2006.01)

(52) U.S. Cl.
CPC ..... *A47F 11/10* (2013.01); *A47F 5/0006* (2013.01); *A47F 9/04* (2013.01); *A47F 2009/041* (2013.01)

(58) Field of Classification Search
CPC ..... A47F 11/10; A47F 5/0823; A47F 5/0006; F21V 21/088; F21W 2131/405
See application file for complete search history.

(56) References Cited

U.S. PATENT DOCUMENTS 3,229,819 A 1/1966 Berk
4,606,466 A 8/1986 Fredrickson
4,747,025 A 5/1988 Barton
4,994,943 A 2/1991 Aspenwall
5,065,290 A 11/1991 Makar et al.
5,508,898 A * 4/1996 McGovern ..... A47F 11/10 312/223.5
5,690,415 A 11/1997 Krehl
5,816,696 A 10/1998 Beisler
6,270,232 B1 8/2001 Shemitz et al.
6,558,017 B1 * 5/2003 Saraiji ..... A47F 3/001 108/23
8,128,251 B2 * 3/2012 Huang ..... A47F 3/001 362/125
2010/0108628 A1 5/2010 Oh
2018/0142846 A1 * 5/2018 Liu ..... A47F 11/10

* cited by examiner

*Primary Examiner* — Robert J May
(74) *Attorney, Agent, or Firm* — Arthur Jacob

(57) ABSTRACT

Apparatus and method illuminate items of merchandise displayed at a point-of-purchase, wherein the items are suspended from a peg having a distal end placed at a support structure, the peg projecting in a longitudinal direction from the support structure to a proximal end placed adjacent the point-of-purchase. An adjacent bar extends from the support structure to a terminal end adjacent the proximal end of the peg and carries a plate secured to the terminal end, with the terminal end of the bar and the plate spaced from the proximal end of the peg. An elongate beam is provided with a track extending in lateral directions along a rearward surface of the beam. The track is located for confronting the terminal end of the bar, and the plate is captured within the track at a selected lateral location along the beam, thereby locating the beam adjacent the terminal end of the bar, proximate the proximal end of the peg, and a light source is extended laterally along the beam, arranged to project illumination toward the items of merchandise displayed at the point-of-purchase.

13 Claims, 3 Drawing Sheets

APPARATUS AND METHOD FOR ILLUMINATING ITEMS OF MERCHANDISE SUSPENDED IN A PEG-TYPE DISPLAY HAVING AN ELONGATE BEAM WITH TRACK THAT IS SECURED TO A TERMINAL END OF A BAR

The present invention relates generally to the display and dispensing of merchandise at a point-of-purchase associated with a peg-type display and dispensing system and pertains, more specifically, to apparatus and method for illuminating items of merchandise suspended in a peg-type display and dispensing system for presentation and selection at a point-of-purchase.

It has become quite common to display and dispense items of merchandise from a peg-type display and dispensing system wherein a point-of-purchase is located at the proximal end of a peg projecting from a support structure where purchasers may view and select items offered for sale. In such systems, serially arranged items of merchandise are suspended from a longitudinally projecting peg, with the items maintained in a longitudinal row along the peg, to be made available for convenient selection at a point-of-purchase. The peg is mounted upon a support structure, such as a wall or a peg board panel, rendering the system simple, versatile and reliable in performance.

The present invention provides an adjunct to the above-described peg-type display and dispensing system, namely, apparatus and method for effectively illuminating the merchandise offered for purchase at the point-of-purchase provided by a peg-type display and dispensing system. As such, the present invention attains several objects and advantages, some of which are summarized as follows: Provides effective illumination for assisting a purchaser in viewing and selecting an item of merchandise at a point-of-purchase provided by a peg-type display and dispensing system; promotes the sale of items of merchandise through an aesthetically enhanced display at a point-of-purchase provided by a peg-type display and dispensing system; enables ease of installation to establish advantageous illumination of merchandise items presented at a point-of-purchase in a peg-type display and dispensing system; improves the presentation of merchandise at a point-of-purchase provided by a peg-type display and dispensing system; makes use of structural features of an existing peg-type merchandise display and dispensing system to simplify the addition of highly desirable illumination of items of merchandise offered for purchase; provides an economical, appealing adjunct to an existing peg-type merchandise display and dispensing system; establishes long-term, effective and reliable illumination of merchandise items offered for sale at a point-of-purchase provided by a peg-type display and dispensing system.

The above objects and advantages, as well as further objects and advantages, are attained by the present invention which may be described briefly as apparatus for illuminating items of merchandise displayed at a point-of-purchase, wherein the items are to be suspended from a peg having a distal end placed at a support structure, with the peg projecting in a longitudinal direction from the support structure to a proximal end placed adjacent the point-of-purchase, adjacent a bar that extends from the support structure to a terminal end adjacent the proximal end of the peg, with the terminal end of the bar spaced from the proximal end of the peg, and a plate having at least one slot extending in a longitudinal direction rearwardly from the plate, the slot being complementary to the terminal end of the bar for receiving the terminal end to secure together the plate and the bar, the apparatus comprising: an elongate beam having a forward surface, a rearward surface and a track extending in lateral directions along the rearward surface of the beam, the track being located for confronting the terminal end of the bar and being dimensioned and configured for receiving the plate within the track to capture the plate at a selected lateral location along the beam, thereby locating and securing the beam adjacent the terminal end of the bar, proximate the proximal end of the peg; and a light source extending laterally along the beam, the light source being arranged to project illumination toward the items of merchandise displayed at the point-of-purchase.

In addition, the present invention provides a method for illuminating items of merchandise displayed at a point-of-purchase wherein, the items are to be suspended from a peg having a distal end placed at a support structure, with the peg projecting in a longitudinal direction from the support structure to a proximal end placed adjacent the point-of-purchase, adjacent a bar that extends from the support structure to a terminal end adjacent the proximal end of the peg, with the terminal end of the bar spaced from the proximal end of the peg, and a plate including at least one slot extending in a longitudinal direction rearwardly from the plate, the slot being complementary to the terminal end of the bar for receiving the terminal end to secure together the plate and the bar, the method comprising: providing an elongate beam having a forward surface, a rearward surface and a track extending in lateral directions along the rearward surface of the beam, and locating the track in confrontation with the terminal end of the bar, and capturing the plate within the track, at a selected lateral location along the beam, thereby locating the beam adjacent the terminal end of the bar, proximate the proximal end of the peg; and extending a light source laterally along the beam, arranged to project illumination toward the items of merchandise displayed at the point-of-purchase.

The present invention will be understood more completely, while still further objects and advantages will become apparent, in the following detailed description of preferred embodiments of the invention illustrated in the accompanying drawing, in which.

Figure 1:
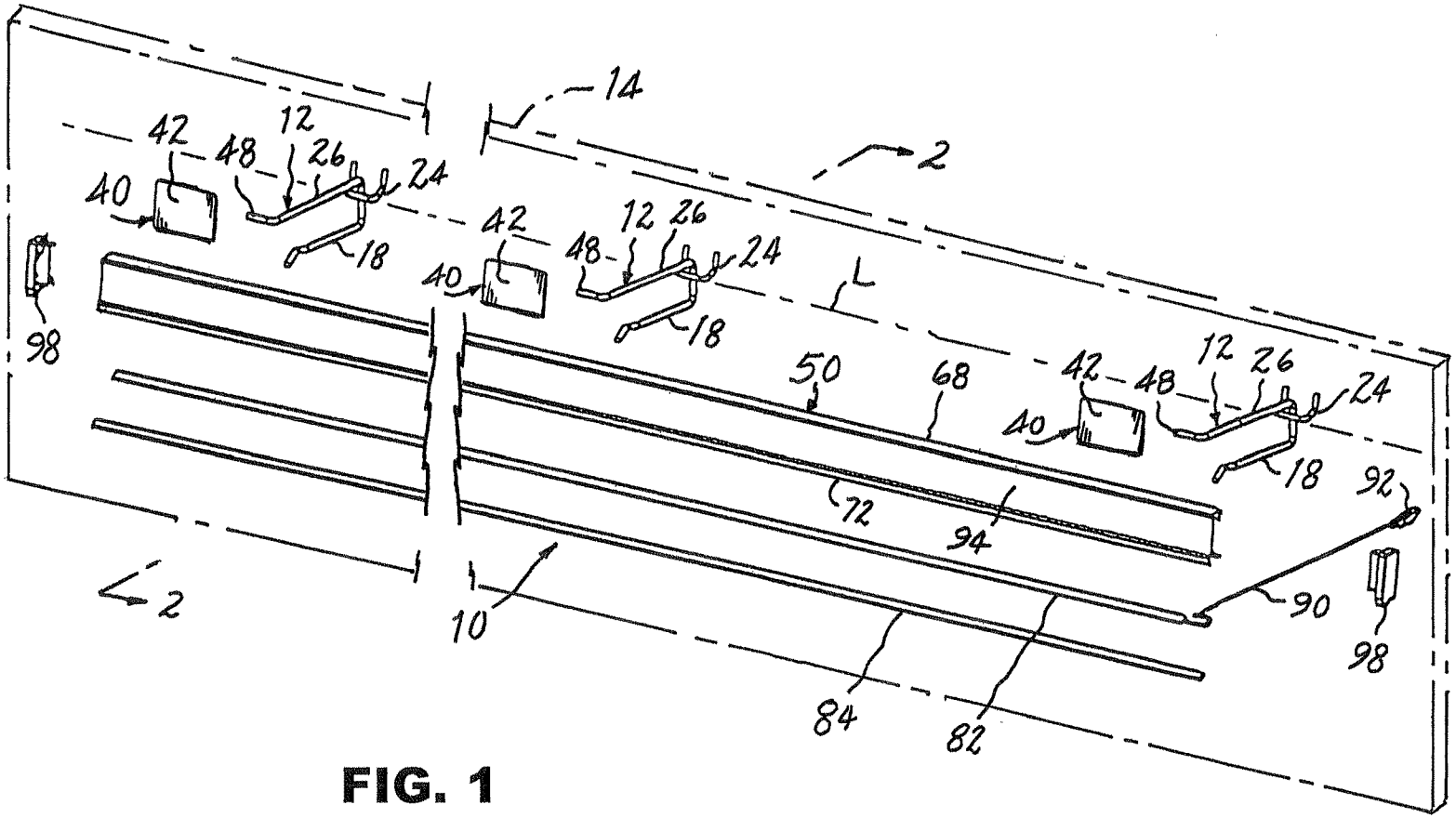
FIG. 1 is an exploded pictorial view showing an apparatus constructed in accordance with the present invention, for installation in connection with a merchandise display and dispensing apparatus and method, in accordance with the present invention.
Figure 2:
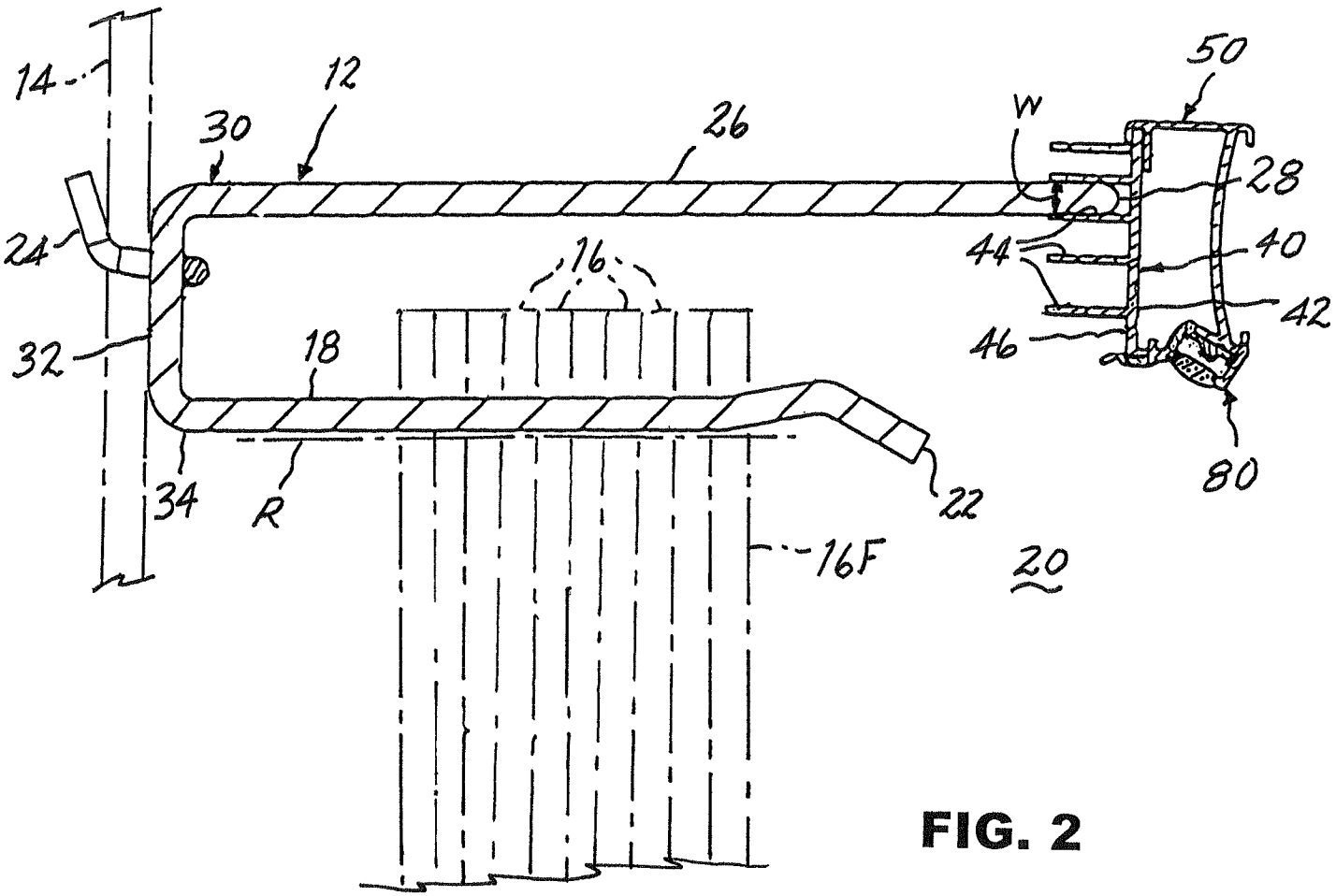
FIG. 2 is an enlarged transverse cross-sectional view of component parts of the apparatus of the invention assembled in accordance with the present invention, the cross-section being taken along line 2-2 of FIG. 1, subsequent to installation.

Referring now to the drawing, and especially to FIGS. 1 and 2 thereof, a peg-type display and dispensing system is shown at 10, in an exploded pictorial view, and is seen to include a plurality of peg hooks 12 ready for installation upon a support structure, shown in the form of a peg board panel illustrated in phantom at 14, for displaying and dispensing items of merchandise, as shown in FIG. 2 in phantom at 16, the items 16 being aligned along a peg hook 12 in a longitudinally-extending row R, with the items 16 suspended from a peg 18 of peg hook 12, for presentation at a point-of-purchase 20 adjacent proximal end 22 of peg 18.

Display and dispensing system 10 includes a plurality of peg hooks 12 spaced apart laterally along a line L extending across panel 14. Each peg hook 12 includes a hook 24 for mounting the peg hook 12 upon peg board panel 14, in a now-conventional manner, and a bar 26 extending from the hook 24, and consequently from panel 14, to a terminal end 28 spaced in an altitudinal direction, upwardly, from the proximal end 22 of peg 18. In the preferred construction, peg 18 and bar 26 are in a unitary construction 30 while hook 24 is integrated with unitary construction 30 at a foot 32 located at the distal end 34 of peg 18, foot 32 serving to stabilize peg hook 12 upon panel 14.

A plate 40 is mounted upon peg hook 12, at the terminal end 28 of bar 26 and, in a now conventional manner, provides a front face 42 for the purpose of carrying information pertaining to the items 16 carried by a corresponding peg 18. To that end, plate 40 includes a slot 44 at the rear face 46 of plate 40 for receiving the terminal end 28 of bar 26 to complete the mounting of plate 40 upon peg hook 12. Bar 26 includes a laterally extending finger 48 at terminal end 28, and slot 44 is complementary to finger 48, thereby providing stability to the connection between bar 26 and plate 40. In the preferred construction, plate 40 is provided with a plurality of slots 44, each having a different width W for accommodating alternate bars (not shown) of corresponding dimensions.

The present invention provides for the effective and aesthetic illumination of at least the forward-most merchandise item 16F suspended from each peg 18 and located at each corresponding point-of-purchase 20. To that end, an elongate beam 50 is provided to extend laterally along line L for juxtaposition with the proximal end 22 of each peg 18. Beam 50 takes advantage of the presence of plates 40 mounted upon peg hooks 12 for locating and securing beam 50 adjacent the terminal end 28 of each bar 26. Thus, with reference to FIGS. 3 and 4, as well as to FIG. 2, beam 50 includes a forward surface 52 and a rearward surface 54, and a track 56 extending in lateral directions along the rearward surface 54 of the beam 50. Each plate 40 has a first edge, in the form of an upper edge 62, and a second edge, in the form of a lower edge 64, spaced altitudinally downwardly from upper edge 62. Track 56 includes a groove 66 extending laterally along the track 56, adjacent the uppermost rim 68 of the track 56, the groove 66 being essentially complementary to upper edge 62 of plate 40, and a latch 70 extending along the lower border 72 of the track 56.

Figure 4:
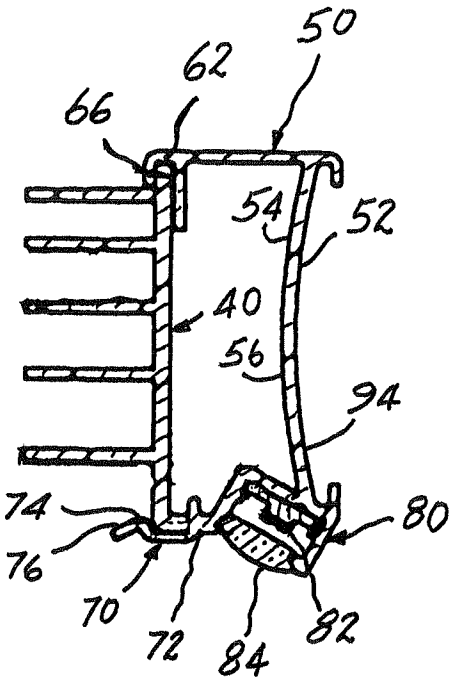
FIG. 4 is a cross-sectional view similar to FIG. 3 and showing the component parts assembled.
Figure 3:
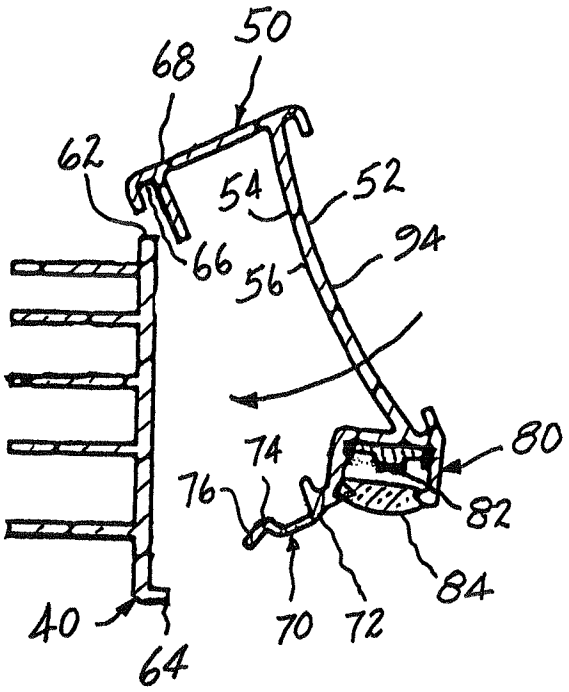
FIG. 3 is an enlarged cross-sectional view of component parts of the apparatus being assembled in accordance with the method of the present invention.

As best seen in FIGS. 3 and 4, latch 70 includes a detent 74 biased resiliently upwardly toward the groove 66, by virtue of the resilient nature of the material of track 56 which, in the preferred embodiment, is an extruded aluminum. A ramp 76 extends along detent 74 in place to be engaged by lower edge 64 of plate 40 upon insertion of the upper edge 62 of plate 40 into groove 66, and movement of lower edge 64 into track 56. Once seated within track 56, plate 40 is captured within track 56 by seating within groove 66 and engagement with detent 74, thereby securing beam 50 upon peg hooks 12, extending laterally along line L.

Beam 50 carries a light source 80, shown in the form of an LED strip 82, and a diffuser lens 84, both extending along the lower border 72 of the beam 50. Upon installation of beam 50 on peg hook 12, as described above, light source 80 is placed adjacent the proximal end 22 of the pegs 18 spaced laterally along line L, arranged to project illumination downwardly toward the items 16 suspended from pegs 18 at points-of-purchase 20. An electrical conductor 90 is connected to LED strip 82 and includes an electrical connector 92 for connecting the LED strip to a source of electrical power (not shown), in a now well-known manner. A price channel 94 is located along the forward surface 52 of beam 50 for carrying information for the convenience of purchasers (not shown), and a pair of end caps 98 are fitted to the beam 50 to complete an aesthetic installation.

Completion of a successful installation of beam 50 upon peg hooks 12 is confirmed by both a tactile and an audible signal provided by a "snap-action" achieved upon the deflection and seating of latch 70 at the lower edge 64 of plate 40, simplifying the completion of a fully functional installation. Such simplified, confirmed installation is particularly advantageous where the apparatus of the present invention is installed upon an existing, already installed peg-type display and dispensing system to thereby establish both the functional and aesthetic features provided by the present invention.

It will be seen that the present invention attains all of the objects and advantages summarized above, namely: Provides effective illumination for assisting a purchaser in viewing and selecting an item of merchandise at a point-of-purchase provided by a peg-type display and dispensing system; promotes the sale of items of merchandise through an aesthetically enhanced display at a point-of-purchase provided by a peg-type display and dispensing system; enables ease of installation to establish advantageous illumination of merchandise items presented at a point-of-purchase in a peg-type display and dispensing system; improves the presentation of merchandise at a point-of-purchase provided by a peg-type display and dispensing system; makes use of structural features of an existing peg-type merchandise display and dispensing system to simplify the addition of highly desirable illumination of items of merchandise offered for purchase; provides an economical, appealing adjunct to an existing peg-type merchandise display and dispensing system; establishes long-term, effective and reliable illumination of merchandise items offered for sale at a point-of-purchase provided by a peg-type display and dispensing system.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. Apparatus for illuminating items of merchandise displayed at a point-of-purchase, wherein the items are to be placed adjacent a bar that extends from a support structure to a terminal end, the apparatus comprising:

a plate having at least one slot extending in a longitudinal direction rearwardly from the plate, the slot being complementary to the terminal end of the bar for receiving the terminal end to secure together the plate and the bar;

an elongate beam having a forward surface, a rearward surface and a track extending in lateral directions along the rearward surface of the beam, the track being located for confronting the terminal end of the bar and being dimensioned and configured for receiving the plate within the track to capture the plate at a selected lateral location along the beam, thereby locating and securing the beam adjacent the terminal end of the bar;

a light source extending laterally along the beam, the light source being arranged to project illumination toward the items of merchandise displayed at the point-of-purchase; and wherein the plate includes a first edge and a second edge spaced altitudinally from the first edge, and the track includes a laterally extending groove and a latch spaced attitudinally opposite from the groove such that upon placement of one of the first and second edges in the groove, the other of the first and second edges will be engaged by the latch to capture the plate within the track.

2. The apparatus of claim 1 wherein the latch includes a detent biased resiliently toward the groove, and a ramp placed for deflecting the detent in response to insertion of the one of the first and second edges of the plate in the groove, and insertion of the other of the first and second edges of the plate into the track, effecting capture by the detent of the plate within the track.

3. The apparatus of claim 2 wherein the latch is spaced attitudinally below the groove.

4. The apparatus of claim 3 wherein the latch is unitary with the beam, and the detent and ramp are unitary with the latch.

5. The apparatus of claim 1 wherein the light source is arranged to project illumination attitudinally downwardly toward the items of merchandise displayed at the point-of-purchase.

6. The apparatus of claim 5 wherein the beam includes a laterally extending lower border, and the light source is integral with the beam along the lower border of the beam.

7. The apparatus of claim 6 including a price channel extending in lateral directions along the forward surface of the beam.

8. A method for illuminating items of merchandise displayed at a point-of-purchase wherein, the items are to be placed adjacent a bar that extends from a support structure to a terminal end, the method comprising:

providing a plate including at least one slot extending in a longitudinal direction rearwardly from the plate, the slot being complementary to the terminal end of the bar for receiving the terminal end to secure together the plate and the bar;

providing an elongate beam having a forward surface, a rearward surface and a track extending in lateral directions along the rearward surface of the beam, and locating the track in confrontation with the terminal end of the bar;

capturing the plate within the track, at a selected lateral location along the beam, thereby locating the beam adjacent the terminal end of the bar;

extending a light source laterally along the beam, arranged to project illumination toward the items of merchandise displayed at the point-of-purchase;

providing the plate with a first edge and a second edge spaced attitudinally from the first edge; and providing the track with a laterally extending groove and a latch spaced attitudinally opposite from the groove such that upon placement of one of the first and second edges in the groove, the other of the first and second edges is engaged by the latch to capture the plate within the track.

9. The method of claim 8 including providing the latch with a detent biased resiliently toward the groove, and a ramp placed for deflecting the detent in response to insertion of the one of the first and second edges of the plate in the groove, and insertion of the other of the first and second edges of the plate into the track, thereby effecting capture by the detent of the plate within the track.

10. The method of claim 9 including constructing the latch unitary with the beam, and the detent and ramp unitary with the latch.

11. The method of claim 8 including arranging the light source to project illumination altitudinally downwardly toward the items of merchandise displayed at the point-of-purchase.

12. The method of claim 11 including providing the beam with a laterally extending lower border, and integrating the light source with the beam along the lower border of the beam.

13. The method of claim 12 including extending a price channel in lateral directions along the forward surface of the beam.

* * * * *